US009388361B2

(12) United States Patent
Terada et al.

(10) Patent No.: US 9,388,361 B2
(45) Date of Patent: Jul. 12, 2016

(54) LUBRICATING OIL ADDITIVE COMPOSITION AND LUBRICATING OIL COMPOSITION

(71) Applicant: IDEMITSU KOSAN CO., LTD., Chiyoda-ku (JP)

(72) Inventors: Izumi Terada, Sodegaura (JP); Junya Iwasaki, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/384,523

(22) PCT Filed: Mar. 13, 2013

(86) PCT No.: PCT/JP2013/056982

§ 371 (c)(1),
(2) Date: Sep. 11, 2014

(87) PCT Pub. No.: WO2013/141108

PCT Pub. Date: Sep. 26, 2013

(65) Prior Publication Data

US 2015/0080278 A1 Mar. 19, 2015

(30) Foreign Application Priority Data

Mar. 21, 2012 (JP) ..... 2012-064390

(51) Int. Cl.
*C10M 141/06* (2006.01)
*C10M 141/12* (2006.01)

(52) U.S. Cl.
CPC ..... *C10M 141/06* (2013.01); *C10M 141/12* (2013.01); *C10M 2215/042* (2013.01); *C10M 2215/086* (2013.01); *C10M 2215/221* (2013.01); *C10M 2215/226* (2013.01); *C10M 2215/28* (2013.01); *C10N 2220/021* (2013.01); *C10N 2230/04* (2013.01); *C10N 2230/10* (2013.01); *C10N 2230/45* (2013.01); *C10N 2240/02* (2013.01); *C10N 2240/08* (2013.01); *C10N 2240/10* (2013.01); *C10N 2240/102* (2013.01); *C10N 2270/02* (2013.01)

(58) Field of Classification Search
CPC ..... C10M 141/06; C10M 141/12; C10M 2215/042; C10M 2215/086; C10M 2215/221; C10M 2215/28
See application file for complete search history.

(56) References Cited

U.S. PATENT DOCUMENTS

| | | | | | |
|---|---|---|---|---|---|
| 3,282,955 | A * | 11/1966 | Le Suer | 548/405 | |
| 3,794,586 | A | 2/1974 | Kimura et al. | | |
| 4,502,970 | A * | 3/1985 | Schetelich | C10M 167/00 | 508/192 |
| 5,078,893 | A * | 1/1992 | Ryer | C10M 141/10 | 252/77 |
| 5,670,464 | A * | 9/1997 | Kita | C10M 133/08 | 508/562 |
| 7,618,929 | B2 * | 11/2009 | Tipton et al. | 508/562 | |
| 2006/0172899 | A1 | 8/2006 | Tipton et al. | | |
| 2011/0030648 | A1 | 2/2011 | Cook et al. | | |

FOREIGN PATENT DOCUMENTS

| | | | |
|---|---|---|---|
| EP | 1 985 690 | A2 | 10/2008 |
| EP | 1 985 690 | A3 | 10/2008 |
| JP | 07-316576 | | 12/1995 |
| JP | 9-100485 | A | 4/1997 |
| JP | 10-8079 | A | 1/1998 |
| JP | 2005-220199 | | 8/2005 |
| JP | 2009-235258 | | 10/2009 |

OTHER PUBLICATIONS

International Search Report issued Jun. 18, 2013 in PCT/JP13/56982 filed Mar. 13, 2013.
Extended European Search Report issued Nov. 30, 2015 in Patent Application No. 13764539.6.
Office Action issued Sep. 29, 2015 in Japanese Patent Application No. 2012-064390 (with English language translation).
Office Action issued Nov. 17, 2015, in corresponding Chinese Patent Application No. 201380011764.4 (with English-language Translation).

* cited by examiner

*Primary Examiner* — Cephia D Toomer
(74) *Attorney, Agent, or Firm* — Oblon, McClelland, Maier & Neustadt, L.L.P.

(57) ABSTRACT

A lubricating oil additive composition contains a borated succinimide derivative and an amino alcohol compound. A lubricating oil composition containing the lubricating oil additive composition is excellent in high-temperature detergency and base value retention (long-drain capabilities) even though a blended content of a metal detergent is low and an ash content is small.

17 Claims, No Drawings

LUBRICATING OIL ADDITIVE COMPOSITION AND LUBRICATING OIL COMPOSITION

TECHNICAL FIELD

The present invention relates to a lubricating oil additive composition and a lubricating oil composition, more specifically, to a lubricating oil additive composition used in an internal combustion engine (e.g., a diesel engine) and a lubricating oil composition containing the lubricating oil additive composition.

BACKGROUND ART

A lubricating oil for an internal combustion engine, particularly for a diesel engine, typically contains a combination of a metal detergent and an ashless dispersant as a detergent dispersant. In general, examples of the metal detergent include sulfonate, phenate, salicylate and phosphonate of an alkali metal or an alkaline earth metal, and an overbased substance thereof.

A countermeasure against environmental pollution caused by nitrogen oxides (NOx) and particulate matters (PM) in exhaust gas has been of great interest in the diesel engine among the internal combustion engine. Accordingly, reduction in the nitrogen oxides and particulate matters in the exhaust gas has been urgent required. As the countermeasure, in order to reduce NOx, exhaust gas recirculation (EGR) is enhanced or a timing of a fuel injection is delayed to lower a combustion peak temperature. However, since the decrease in the combustion peak temperature causes increase in black exhaust and PM, an exhaust gas aftertreatment device needs to be attached. As the exhaust gas aftertreatment device, a PM trap, an oxidation catalyst or the like has been examined. However, since having a filter structure, the PM trap, the oxidation catalyst or the like is clogged with a metal content in a typical diesel engine oil.

On the other hand, reduction of the metal content in the oil, in other words, reduction of a metal detergent and an antiwear agent causes deterioration of detergency and wear resistance. Particularly, the reduction of the metal detergent results in decrease in an initial base value. Accordingly, in order to maintain long-drain capabilities at the same level as in a typical oil, development of a new lubricating oil for an internal combustion engine has been desired.

For instance, Patent Literature 1 discloses formulation of an additive containing amino alcohol and a reduced content of a metal detergent. Patent Literature 1 discloses that, even when the content of the metal detergent is small (i.e., a low ash content), detergency within the diesel engine can be enhanced by blending this additive in the lubricating oil, thereby prolonging a lifetime of the lubricating oil.

CITATION LIST

Patent Literature(s)

Patent Literature 1: JP-A-07-316576

SUMMARY OF THE INVENTION

Problems to be Solved by the Invention

However, even with the formulation of the additive disclosed in Patent Literature 1, it is not always easy to obtain high-temperature detergency and base value retention that are equivalent to or more than those of a typical oil.

An object of the invention is to provide a lubricating oil additive composition excellent in high-temperature detergency and base value retention, and a lubricating oil composition containing the lubricating oil additive composition.

Means for Solving the Problems

As a result of diligent studies to solve the above problem, the inventors found that a combination of a borated alkyl/alkenyl succinimide and an amino alcohol compound in use provides a synergistic effect, leading to results equivalent to or superior to those obtained when one of the above compounds is used alone. Based on the findings, the inventors have completed the invention.

In other words, the invention provides a lubricating oil additive composition and a lubricating oil composition as follows.

(1) According to an aspect of the invention, a lubricating oil additive composition contains a borated succinimide derivative and an amino alcohol compound.

(2) In the lubricating oil additive composition according to the above aspect of the invention, the succinimide derivative is a succinimide having an alkyl group or an alkenyl group.

(3) In the lubricating oil additive composition according to the above aspect of the invention, the alkyl group or the alkenyl group has a number average molecular weight of 300 to 3000.

(4) In the lubricating oil additive composition according to the above aspect of the invention, the borated succinimide derivative contains boron in a range of 0.1 mass % to 3 mass % of a total amount of the succinimide derivative.

(5) In the lubricating oil additive composition according to the above aspect of the invention, the amino alcohol compound is obtained by reacting a compound (A) having an epoxy group with a compound (B) having at least one amino group selected from a primary amino group and a secondary amino group.

(6) In the lubricating oil additive composition according to the above aspect of the invention, the compound (A) has an epoxy group and one of a hydrocarbon group and an oxygen-containing hydrocarbon group which is bonded to the epoxy group.

(7) In the lubricating oil additive composition according to the above aspect of the invention, the compound (A) has 6 to 40 carbon atoms.

(8) In the lubricating oil additive composition according to the above aspect of the invention, the compound (B) has 1 to 10 nitrogen atoms and 2 to 40 carbon atoms.

(9) In the lubricating oil additive composition according to the above aspect of the invention, a ratio of a total mole number of the compound (A) to a total mole number of the compound (B) is in a range of 0.7:1 to 12:1.

(10) In the lubricating oil additive composition according to the above aspect of the invention, the compound (B) is polyamine.

(11) In the lubricating oil additive composition according to the above aspect of the invention, a blend ratio of the succinimide derivative to the amino alcohol compound is in a range of 1:0.01 to 1:2.

(12) According to another aspect of the invention, a lubricating oil composition contains the above lubricating oil additive composition.

(13) According to the above aspect of the invention, the lubricating oil composition is a lubricating oil for an internal combustion engine.

The lubricating oil composition containing the lubricating oil additive composition of the invention is excellent in high-temperature detergency and base value retention even with a low ash content.

DESCRIPTION OF EMBODIMENT(S)

A lubricating oil additive composition according to an exemplary embodiment of the invention (hereinafter, occasionally simply referred to as "the present additive composition") contains a borated succinimide derivative and an amino alcohol compound. A detailed description of the exemplary embodiment will be made below.

Borated Succinimide Derivative

The borated succinimide derivative used in the present additive composition is provided by borating a succinimide derivative. In terms of high-temperature detergency, the succinimide derivative preferably has a structure of alkenyl/alkyl succinic acid monoimide represented by a formula (1) below, a structure of alkenyl/alkyl succinic acid bisimide represented by a formula (2) below, and the like.

[Formula 1]

(1)

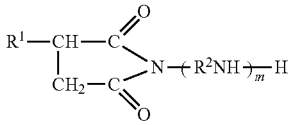

(2)

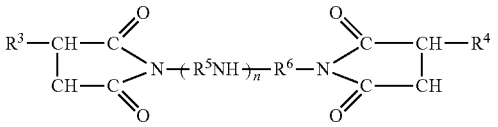

In the formulae (1) and (2), each of $R^1$, $R^3$ and $R^4$ is an alkenyl group or an alkyl group and preferably has a number average molecular weight in a range of 300 to 3,000, more preferably in a range of 500 to 3,000.

When the number average molecular weight of each of $R^1$, $R^3$ and $R^4$ is less than 300, the solubility to a base oil and the high-temperature detergency may be decreased. When the number average molecular weight of each of $R^1$, $R^3$ and $R^4$ is more than 3,000, a base value may be decreased. $R^3$ and $R^4$ may be the same as or different from each other.

Each of $R^2$, $R^5$ and $R^6$ is an alkylene group having 2 to 5 carbon atoms. $R^5$ and $R^6$ may be the same as or different from each other. m and n represent an integer in a range of 1 to 10. Herein, m and n are each preferably in a range of 2 or 5. When m and n are 2 or more, the high-temperature detergency becomes more favorable. When m and n are 5 or less, the solubility to the base oil becomes more favorable.

Examples of the alkenyl group are a polybutenyl group, polyisobutenyl group, and ethylene-propylene copolymer. Examples of the alkyl group are provided by hydrogenating the polybutenyl group, polyisobutenyl group, and ethylene-propylene copolymer. Preferable examples of the alkenyl group are a polybutenyl group and a polyisobutenyl group. The polybutenyl group is preferably obtained as a polymerized mixture of 1-butene and isobutene, or polymerized highly-pure isobutene. Preferable examples of the alkyl group are represented by an alkyl group obtained by hydrogenating the polybutenyl group or the polyisobutenyl group.

The above alkenyl/alkyl succinimide can be produced, for instance, by reacting polyamine with alkenyl succinic anhydride, which is a reactant of polyolefin and maleic anhydride, or with alkyl succinic anhydride, which is obtained by hydrogenating the alkenyl succinic anhydride. The above succinic acid monoimide and succinic acid bisimide can be produced by changing a reaction ratio of alkenyl succinic anhydride or alkyl succinic anhydride to polyamine.

As an olefin monomer to form the above polyolefin, one or more kinds of α-olefins having 2 to 18 carbon atoms may be mixed in use, among which a mixture of isobutene and butene-1 is preferably usable.

On the other hand, as polyamine, polyalkylene polyamine and polyalkylene polyamine containing a cyclic amine are preferably usable. Examples of polyalkylene polyamine include a single diamine (e.g., ethylenediamine, propylenediamine, butylenediamine, and pentylenediamine), diethylenetriamine, triethylenetetramine, tetraethylenepentamine, pentaethylenehexamine, aminoethylpyperadine, di(methylethylene)triamine, dibuthylenetriamine, tributylenetetramine and pentapentylenehexamine.

A borated alkenyl/alkyl succinimide produced by a typical method is usable.

For instance, the borated alkenyl/alkyl succinimide is obtainable by reacting the above polyolefin with maleic anhydride to provide alkenyl succinic anhydride, subsequently reacting the alkenyl succinic anhydride with the above polyamine to imidize the alkenyl succinic anhydride, and further reacting the imidized alkenyl succinic anhydride with a boron compound such as boric oxide, halogenated boron, boric acid, boric anhydride, borate ester and an ammonium salt of boron acid.

A mass ratio (B/N) of boron (B) to nitrogen (N) contained in the above borated alkenyl/alkyl succinimide is preferably 0.5 or more, more preferably 0.6 or more, further more preferably 0.8 or more. When the B/N ratio is 0.5 or more, the high-temperature detergency is significantly improved.

A content of boron derived from the above borated alkenyl/alkyl succinimide is preferably in a range of 0.1 mass % to 3 mass % of the borated alkenyl/alkyl succinimide. Since a predetermined content or more of boron is present, the high-temperature detergency is more effectively exhibited. When the content of boron is less than 0.1 mass %, a sufficient high-temperature detergency may not be obtained. When the content of boron exceeds 3 mass %, the high-temperature detergency may not be further improved either.

The content of boron is preferably in a range of 0.02 mass % to 0.6 mass % of a total amount of a lubricating oil composition later described. Since a predetermined content or more of boron is present, the high-temperature detergency is more effectively exhibited. When the content of boron is less than 0.02 mass %, a sufficient high-temperature detergency may not be obtained. When the content of boron exceeds 0.6 mass %, the high-temperature detergency may not be further improved either.

Amino Alcohol Compound

An amino alcohol compound contained in the present additive composition is obtainable, for instance, by reacting a compound (A) having an epoxy group with a compound (B) having at least one of a primary amino group and a secondary amino group. Synthesis examples are shown below.

(A) Compound having Epoxy Group

A compound having an epoxy group is preferably provided by bonding an epoxy group and one of a hydrocarbon group and an oxygen-containing hydrocarbon group. Such hydrocarbon group and oxygen-containing hydrocarbon group may be saturated or unsaturated, aliphatic or aromatic, or linear, branched or cyclic. The hydrocarbon group is preferably an alkyl group or an alkenyl group, among which an alkyl group is more preferable. Examples of the alkyl group or the alkenyl group include a hexyl group, hexenyl group, octyl group, octenyl group, decyl group, decenyl group, dodecyl group, dodecenyl group, tetradecyl group, tetradecenyl group, hexadecyl group, hexadecenyl group, octadecyl group, octadecenyl group, isostearyl group, decene trimer group and polybutenyl group.

The compound (A) preferably has 6 to 40 carbon atoms. The compound (A) having the carbon atoms of less than 6 may not be sufficiently dissolved in the lubricating base oil, while the compound (A) having the carbon atoms of more than 40 may not have a high base value. Further preferably, the compound (A) has 6 to 30 carbon atoms.

Examples of the compound (A) include 1,2-epoxyoctane, 1,2-epoxydecane, 1,2-epoxydodecane, 1,2-epoxytetradecane, 1,2-epoxyhexadecane, 1,2-epoxyoctadecane, 1,2-epoxyeicosane, 1,2-epoxydodecene, 1,2-epoxytetradecene, 1,2-epoxyhexadecene, 1,2-epoxyoctadecene, and 1,2-epoxy-2-octyldodecane.

Examples of the compound (A) having an oxygen atom in a main chain include butyl glycidyl ether, 2-ethylhexyl glycidyl ether, hexyl glycidyl ether, heptyl glycidyl ether, octyl glycidyl ether, decyl glycidyl ether, dodecyl glycidyl ether, hexadecyl glycidyl ether, octadecyl glycidyl ether, and 2-decyltetradecyl glycidyl ether.

(B) Compound having at Least One of Primary Amino Group and Secondary Amino Group The compound (B) is exemplified by a primary amine and a secondary amine and may also be a polyamine such as polyalkylene amine, in which the polyamine may contain a cyclic amine.

The primary amine preferably has a hydrocarbon group having 6 to 40 carbon atoms, in which the hydrocarbon group may be saturated or unsaturated, aromatic, or linear, branched or cyclic. Moreover, the primary amine may contain an oxygen atom. The primary amine containing the hydrocarbon group having the carbon atoms of less than 6 may not be sufficiently dissolved in the lubricating base oil, while the primary amine containing the hydrocarbon group having the carbon atoms of more than 40 may not have a high base value. Further preferably, the hydrocarbon group has 6 to 30 carbon atoms. Examples of the hydrocarbon group include an alkyl group or an alkenyl group such as a hexyl group, hexenyl group, octyl group, octenyl group, decyl group, decenyl group, dodecyl group, dodecenyl group, tetradecyl group, tetradecenyl group, hexadecyl group, hexadecenyl group, octadecyl group, octadecenyl group, isostearyl group, decene trimer group and polybutenyl group.

Examples of the primary amine include hexylamine, octylamine, decylamine, dodecylamine, tetradecylamine, hexadecylamine, octadecyclamine, 2-ethylhexylamine, 2-decyltetradecylamine, and oleylamine.

The secondary amine preferably has a hydrocarbon group having 6 to 40 carbon atoms in total (i.e., the number of carbon atoms in the entire amine), in which the hydrocarbon group may be saturated or unsaturated, aromatic, or linear, branched or cyclic. Moreover, the secondary amine may contain an oxygen atom. The secondary amine having the hydrocarbon group having the carbon atoms of less than 6 may not be sufficiently dissolved in the lubricating base oil, while the secondary amine having the hydrocarbon group having the carbon atoms of more than 40 may not have a high base value. Further preferably, the hydrocarbon group has 6 to 30 carbon atoms.

Examples of the secondary amine include dihexylamine, dioctylamine, didecylamine, didodecylamine, ditetradecylamine, dihexadecylamine, dioctadecyclamine, di-2-ethylhexylamine, dioleylamine, methylstearylamine, ethylstearylamine, and methyloleylamine. The secondary amine may be a cyclic secondary amine such as piperidine, piperazine, morpholine, and 4-methylpiperazine.

When the compound (B) is polyalkylene polyamine, it is preferable that a total number of nitrogen is in a range of 2 to 10 and each of the alkylene groups has 1 to 6 carbon atoms. The polyalkylene polyamine may further contain an oxygen atom. The total number of nitrogen is preferably 10 or less since the polyalkylene polyamine is sufficiently dissolved in the lubricating base oil. Each of the alkylene groups preferably has 6 carbon atoms or less since the polyalkylene polyamine having such an alkylene group exhibits a sufficient reactivity to easily obtain a target product and improve the high-temperature detergency and base value retention.

Examples of the polyalkylene polyamine include diethylenetriamine, triethylenetetramine, tetraethylenepentamine, pentaethylenehexamine, dipropylenetriamine, dihexyltriamine, and N-hydroxyethyl diaminopropane. The polyalkylene polyamine may have a cyclic alkylene amine. Example of such a polyalkylene polyamine include aminoethylpiperazine, 1,4-bisaminopropyl piperazine, 1-(3-aminopropyl)-morpholine, and 1-piperazine ethanol.

The amino alcohol compound contained in the present additive composition is obtainable by reacting the compound (A) having an epoxy group with the compound (B) having a predetermined amino group at a ratio, which is between a total mole number of the compound (A) and a total mole number of the compound (B), being in a range of 0.7:1 to 12:1, more preferably in a range of 1:1 to 10:1.

Herein, the reaction between the compound (A) and the compound (B) is preferably conducted at the temperature from about 50 degrees C. to about 250 degrees C., more preferably from about 100 degrees C. to about 200 degrees C.

A composition ratio between the borated succinimide derivative and the amino alcohol compound in the present additive composition is preferably in a range of 1:0.01 to 1:2, more preferably in a range of 1:0.02 to 1:1.5.

The lubricating oil composition according to the exemplary embodiment can be prepared by blending the present additive composition containing the borated succinimide derivative and the amino alcohol compound in a hydrocarbon oil and/or a synthetic oil (a lubricating base oil). A content of the present additive composition is preferably in a range of 0.01 mass % to 50 mass % of the total amount of the lubricating oil composition, more preferably in a range of 0.1 mass % to 30 mass %.

The present additive composition exhibits excellent high-temperature detergency and base value retention as an ashless detergent dispersant in the lubricating oil composition. Moreover, the present additive composition can also be blended to a fuel oil in a form of a hydrocarbon oil. When the present additive composition is blended the fuel oil, a preferable content of the present additive composition is approximately in a range of 0.001 mass % to 1 mass % of the fuel oil.

The lubricating base oil with which the present additive composition is blended is not particularly limited but may be a mineral oil and a synthetic oil as long as being generally usable as the base oil of the lubricating oil. However, the lubricating base oil preferably has a kinematic viscosity at 100 degrees C. in a range of 1 $mm^2/s$ to 50 $mm^2/s$, more preferably in a range of 2 $mm^2/s$ to 20 $mm^2/s$. A pour point of the base oil, which is an index of low-temperature fluidity, is not particularly limited, but is preferably typically minus 10 degrees C. or less.

Herein, the mineral oil may be either a lubricating oil fraction derived from paraffinic crude oil, naphthenic crude oil, aromatic crude oil and the like or a fuel oil fraction derived from gasoline, kerosene, light oil and the like. Alternatively, a mineral oil produced by any purification methods such as solvent purification, hydrorefining, hydrocracking or the like is also usable. As the synthetic oil, polyphenyl ether, alkyl benzene, alkyl naphthalene, ester oil, glycol-synthetic oil or polyolefin synthetic oil and the like are usable.

The present additive composition is excellent in the high-temperature detergency and base value retention even with a low ash content. Accordingly, the lubricating oil composition according to the exemplary embodiment containing the present additive composition can prevent adverse effects on an exhaust purifying device such as a particulate trap and an oxidation catalyst that oxidizes unburned fuel and a lubricating oil, whereby a future exhaust gas regulation can also be handled. Consequently, the lubricating oil composition according to the exemplary embodiment can be suitably usable as a lubricating oil for an internal combustion engine such as a gasoline engine, diesel engine and two-cycle-engine. The lubricating oil composition according to the exemplary embodiment can also be suitably usable as a gear oil, bearing oil, transmission oil, shock absorber oil or industrial lubricating oil.

In the invention, as long as the advantages of the invention are not hampered, an antioxidant, an antiwear agent, other detergent dispersants, a viscosity index improver, a pour point improver and other additives may be used.

EXAMPLES

Next, the invention will be described further in detail with reference to examples. However, it should be noted that the scope of the invention is by no means limited by the examples.

Firstly, Synthesis Examples 1 to 13 are shown below on the amino alcohol compound.

Synthesis Example 1

To a 200-mL separable flask, 89.3 g (485 mmol) of 1,2-epoxydodecane and 10.0 g (97.1 mmol) of diethylenetriamine (DETA) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (a target). A yield of the obtained target was 99.0 g. A base value of the obtained target was 106.6 mgKOH/g (hydrochloric acid method: hereinafter the same method was used).

Synthesis Example 2

To a 200-mL separable flask, 82.2 g (342 mmol) of 1,2-epoxyhexadecane and 10.0 g (68.5 mmol) of triethylenetetramine (TETA) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 92.0 g. A base value of the obtained target was 95.4 mgKOH/g.

Synthesis Example 3

To a 200-mL separable flask, 76.2 g (317 mmol) of 1,2-epoxyhexadecane and 10.0 g (53.0 mmol) of tetraethylenepentamine (TEPA) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 86.0 g. A base value of the obtained target was 100.3 mgKOH/g.

Synthesis Example 4

To a 200-mL separable flask, 99.8 g (372 mmol) of 1,2-epoxyoctadecane and 16.0 g (144 mmol) of aminoethylpiperazine were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 115.3 g. A base value of the obtained target was 112.1 mgKOH/g.

Synthesis Example 5

To a 200-mL separable flask, 41.6 g (155 mmol) of 1,2-epoxyoctadecane, 10.0 g (77.5 mmol) of 1,2-epoxyoctane and 10.0 g (77.5 mmol) of aminoethylpiperazine (Aep) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 60.3 g. A base value of the obtained target was 140.0 mgKOH/g.

Synthesis Example 6

To a 200-mL separable flask, 44.7 g (186 mmol) of 1,2-epoxyhexadecane and 8.0 g (62.0 mmol) of aminoethylpiperazine (Aep) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 52.4 g. A base value of the obtained target was 124.3 mgKOH/g.

Synthesis Example 7

To a 500-mL separable flask, 83.2 g (310 mmol) of 1,2-epoxyoctadecane and 20.0 g (155 mmol) of aminoethylpiperazine were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 102.0 g. A base value of the obtained target was 160.7 mgKOH/g.

Synthesis Example 8

To a 500-mL separable flask, 58.5 g (218 mmol) of 1,2-epoxyoctadecane and 20.0 g (230 mmol) of morpholine (Mor) were put. The obtained mixture was reacted at a temperature around 130 degrees C. to 140 degrees C. for two hours, subsequently heated up to 170 degrees C. and reacted for two hours. The reactant was cooled to distill excessive morpholine under the reduced pressure, whereby an amino alcohol compound (the target) was obtained. A yield of the obtained target was 73.3 g. A base value of the obtained target was 115.1 mgKOH/g.

Synthesis Example 9

To a 500-mL separable flask, 70.0 g (261 mmol) of 1,2-epoxyoctadecane and 26.1 g (261 mmol) of 4-methylpiperazine (MP) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 93.9 g. A base value of the obtained target was 158.8 mgKOH/g.

Synthesis Example 10

To a 500-mL separable flask, 72.0 g (300 mmol) of 1,2-epoxyhexadecane and 15.0 g (75 mmol) of 1,4-bisaminopropylpiperazine (bAPP) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 82.5 g. A base value of the obtained target was 151.8 mgKOH/g.

Synthesis Example 11

To a 500-mL separable flask, 41.3 g (172 mmol) of 1,2-epoxyhexadecane and 5.0 g (43.1 mmol) of hexamethylenediamine (HMD) were put. The obtained mixture was reacted at a temperature around 130 degrees C. to 140 degrees C. for two hours, subsequently heated up to 170 degrees C. and reacted for two hours. The reactant was cooled to obtain an amino alcohol compound (the target). A yield of the obtained target was 45.8 g. A base value of the obtained target was 102.2 mgKOH/g.

Synthesis Example 12

To a 500-mL separable flask, 64.9 g (349 mmol) of 2-ethylhexylglycidylether (C8Gly) and 15.0 g (116 mmol) of aminoethylpiperazine (Aep) were put. The obtained mixture was reacted at a temperature around 130 degrees C. to 140 degrees C. for three hours. Subsequently, the reactant was cooled to obtain an amino alcohol compound (the target). A yield of the obtained target was 79.1 g. A base value of the obtained target was 159.9 mgKOH/g.

Synthesis Example 13

To a 500-mL separable flask, 36.1 g (194 mmol) of 2-ethylhexylglycidylether (C8Gly) and 4.0 g (38.8 mmol) of diethylenetriamine (DETA) were put. The obtained mixture was reacted at a temperature around 130 degrees C. to 140 degrees C. for three hours. Subsequently, the reactant was cooled to obtain an amino alcohol compound (the target). A yield of the obtained target was 39.3 g. A base value of the obtained target was 115.3 mgKOH/g.

The above amino alcohol compounds in Synthesis Examples 1 to 13 are shown in Table 1.

TABLE 1

| | Amino Alcohol Compound | | Base Value |
|---|---|---|---|
| | Amine | Epoxy | (mgKOH/g) |
| Synthesis Ex. 1 | DETA | C12 | 106.6 |
| Synthesis Ex. 2 | TETA | C16 | 95.4 |
| Synthesis Ex. 3 | TEPA | C16 | 100.3 |
| Synthesis Ex. 4 | Aep | C18 | 112.1 |
| Synthesis Ex. 5 | Aep | C18, C8 | 140.0 |
| Synthesis Ex. 6 | Aep | C16 | 124.3 |
| Synthesis Ex. 7 | Aep | C18 | 160.7 |
| Synthesis Ex. 8 | Mor | C18 | 115.1 |
| Synthesis Ex. 9 | MP | C18 | 158.8 |
| Synthesis Ex. 10 | bAPP | C16 | 151.8 |
| Synthesis Ex. 11 | HMD | C16 | 102.2 |
| Synthesis Ex. 12 | Aep | C8Gly | 159.9 |
| Synthesis Ex. 13 | DETA | C8Gly | 115.3 |

Examples 1-14, Comparatives 1-3

Lubricating oil compositions were prepared as sample oils using the amino alcohol compounds obtained in Synthesis Examples 1 to 13 and borated succinimide (additives A and B) shown below. Specifically, a lubricating oil composition was prepared by using 5 to 10 mass % of borated succinimide and 1 to 4 mass % of each of the amino alcohol compounds and adjusting an amount of a mineral oil of 500 neutral fraction so that a total amount of the borated succinimide, the amino alcohol compound and the mineral oil was 100 mass %.

Additive A: Borated Polybutenyl Succinimide

Number average molecular weight of the polybutenyl group: 1000

Base value: 39.7 mgKOH/g

Boron content: 2.0 mass %

Additive B: Borated Polybutenyl Succinimide

Number average molecular weight of the polybutenyl group: 960

Base value: 29.4 mgKOH/g

Boron content: 2.0 mass %

The prepared sample oils were evaluated in terms of the high-temperature detergency and base value retention by a hot tube test under the following conditions. The results are shown in Table 2.

Hot Tube Test 0.3 mL/hr of each of the sample oils and 10 mL/min of air were continuously flowed for 16 hours through a glass tube having a 2-mm inner diameter and kept at a temperature of 270 degrees C. Lacquer (deposit) adhered in the glass tube was compared with a color sample and was evaluated by grades from 10 points in a case of transparency to 0 point in a case of black. At the same time, a mass of the lacquer adhered in the glass tube was measured. The results show that the higher the grade is or the smaller the amount of the lacquer is, the higher performance of the lubricating oil composition is.

The sample oils obtained after the above hot tube test were collected and a base value of each of the sample oils was measured by a hydrochloric acid method. The base value retention was evaluated by comparing the obtained base value with the base value before the test to provide a residual base value ratio (%). The results show that the higher the residual base value ratio is, the more excellent the base value retention is.

Calculation method: Residual base value ratio=(Base value after the test/Initial base value)×100

TABLE 2

| | Added | | | Added | | Evaluation Results (Hot tube test) | | |
|---|---|---|---|---|---|---|---|---|
| | Additive | Amount (mass %) | Compounds in Synthesis Ex. | Amount (mass %) | Mineral Oil (mass %) | Grades | Deposit (mg) | Residual Base Value Ratio (%) |
| Example 1 | Additive B | 7 | Synthesis Ex. 1 | 4 | 89 | 9 | 0.3 | 39.9 |
| Example 2 | Additive B | 7 | Synthesis Ex. 2 | 4 | 93 | 10 | 4.7 | 35 |
| Example 3 | Additive B | 7 | Synthesis Ex. 3 | 4 | 93 | 10 | 4.9 | 31 |
| Example 4 | Additive B | 5 | Synthesis Ex. 4 | 2 | 93 | 9 | 0.2 | 25.6 |
| Example 5 | Additive A | 10 | Synthesis Ex. 4 | 2 | 88 | 4 | 3.8 | 7.1 |
| Example 6 | Additive B | 5 | Synthesis Ex. 5 | 2 | 93 | 8 | 0.3 | 30.6 |
| Example 7 | Additive B | 5 | Synthesis Ex. 6 | 2 | 93 | 9 | 0.2 | 26.4 |
| Example 8 | Additive B | 5 | Synthesis Ex. 7 | 2 | 93 | 9 | 0 | 24.5 |
| Example 9 | Additive B | 5 | Synthesis Ex. 8 | 2 | 93 | 8 | 2 | 26.7 |
| Example 10 | Additive B | 5 | Synthesis Ex. 9 | 1 | 94 | 9 | 1.5 | 30.7 |
| Example 11 | Additive B | 7 | Synthesis Ex. 10 | 4 | 93 | 7 | 0.4 | 30.6 |
| Example 12 | Additive B | 7 | Synthesis Ex. 11 | 4 | 93 | 10 | 0.6 | 34 |
| Example 13 | Additive B | 5 | Synthesis Ex. 12 | 2 | 93 | 5 | 3.5 | 26.9 |
| Example 14 | Additive B | 5 | Synthesis Ex. 13 | 2 | 93 | 5 | 3.7 | 25.3 |
| Comparative 1 | Additive A | 10 | — | — | 90 | 0 | 7 | 3.3 |
| Comparative 2 | Additive B | 5 | — | — | 95 | 0 | 10.5 | 2.7 |
| Comparative 3 | Additive B | 7 | — | — | 93 | 0 | 8.1 | 3.1 |

Evaluation Results

The results of Table 2 show that the sample oils of Examples 1 to 14 exhibit considerably excellent high-temperature stability, high-temperature detergency, base value retention and particle dispersibility even with a low ash content. In other words, the lubricating oil additive composition and the lubricating oil composition of the invention can prevent adverse effects on an exhaust purifying device such as a particulate trap and an oxidation catalyst that oxidizes unburned fuel and a lubricating oil, thereby meeting a future exhaust gas regulation. Accordingly, it is recognizable that the lubricating oil additive composition and the lubricating oil composition of the invention are particularly suitable for an internal combustion engine. In contrast, since the sample oils of Comparatives 1 to 3 do not contain a predetermined amino alcohol compound although containing borated polybutenyl succinimide (an ashless dispersant), the high-temperature detergency is poor and a residual base value is low.

The invention claimed is:

1. A lubricating oil additive composition, comprising:
a borated succinimide derivative; and
an amino alcohol compound;
wherein the amino alcohol compound is obtained by reacting a compound (A) having an epoxy group with a compound (B) having a secondary cyclic amino group.

2. The composition according to claim 1, wherein the succinimide derivative is a succinimide having an alkyl group or an alkenyl group.

3. The composition according to claim 2, wherein the alkyl group or the alkenyl group has a number average molecular weight of from 300 to 3000.

4. The composition according to claim 1, wherein the borated succinimide derivative comprises boron in an amount of 0.1 mass % to 3 mass % based on a total mass of the succinimide derivative.

5. The composition according to claim 1, wherein the compound (A) comprises an epoxy group and one of a hydrocarbon group and an oxygen-containing hydrocarbon group which is bonded to the epoxy group.

6. The composition according to claim 5, wherein the compound (A) has from 6 to 40 carbon atoms.

7. The composition according to claim 1, wherein the compound (B) has from 1 to 10 nitrogen atoms and from 2 to 40 carbon atoms.

8. The composition according to claim 1, wherein the compound (A) is reacted with the compound (B) in a molar ratio (moles compound (A):moles compound (B)) of 0.7:1 to 12:1.

9. The composition according to claim 1, wherein the compound (B) is polyamine.

10. The composition according to claim 1, wherein a blend ratio of the succinimide derivative to the amino alcohol compound is from 1:0.01 to 1:2.

11. A lubricating oil composition comprising the composition according to claim 1.

12. The lubricating oil composition according to claim 11, wherein the lubricating oil composition is a lubricating oil suitable for an internal combustion engine.

13. The composition according to claim 1 wherein the compound (A) is selected from the group consisting of 1,2-epoxyoctane, 1,2-epoxydecane, 1,2-epoxydodecane, 1,2-epoxytetradecane, 1,2-epoxyhexadecane, 1,2-epoxyoctadecane, 1,2-epoxyeicosane, 1,2-epoxydodecene, 1,2-epoxytetradecene, 1,2-epoxyhexadecene, 1,2-epoxyoctadecene, 1,2-epoxy-2-octyldodecane, butyl glycidyl ether, 2-ethylhexyl glycidyl ether, hexyl glycidyl ether, heptyl glycidyl ether, octyl glycidyl ether, decyl glycidyl ether, dodecyl glycidyl ether, hexadecyl glycidyl ether, octadecyl glycidyl ether, and 2-decyltetradecyl glycidyl ether.

14. The composition according to claim 1, wherein the compound (B) is selected from the group consisting of piperidine, piperazine, aminoethylpiperazine, morpholine, 4-methylpiperazine, 1,4-bisaminopropylpiperazine.

15. The composition according to claim 1, wherein:
the compound (A) is selected from the group consisting of 1,2-epoxyoctane, 1,2-epoxydodecane, 1,2-epoxyhexadecane, 1,2-epoxyoctadecane, and 2-ethylhexylglycidylether: and
the compound (B) is selected from the group consisting of aminoethylpiperazine, morpholine, 4-methylpiperazine, and 1,4-bisaminopropylpiperazine.

16. The composition according to claim 15, wherein the compound (A) is reacted with the compound (B) in a molar ratio (moles compound (A):moles compound (B)) of 0.94:1 to 5:1.

17. A lubricating oil composition, comprising:
a base oil; and
the composition according to claim 16;

wherein:

the borated succinimide derivative is present in the lubricating oil composition in an amount of 5 to 10 mass %; and the amino alcohol compound is present in the lubricating oil composition in an amount of 1 to 4 mass %.

* * * * *